US008840237B2

(12) United States Patent
Kleine Jeager et al.

(10) Patent No.: US 8,840,237 B2
(45) Date of Patent: Sep. 23, 2014

(54) PRINTING MACHINE AND METHOD FOR PRINTING A SUBSTRATE

(75) Inventors: Frank Kleine Jeager, Bad Duerkheim (DE); Juergen Kaczun, Wachenheim (DE); Udo Lehmann, Waldalgesheim (DE)

(73) Assignee: BASF SE, Ludwigshafen (DE)

( * ) Notice: Subject to any disclaimer, the term of this patent is extended or adjusted under 35 U.S.C. 154(b) by 257 days.

(21) Appl. No.: 13/140,480

(22) PCT Filed: Dec. 14, 2009

(86) PCT No.: PCT/EP2009/067021

§ 371 (c)(1),
(2), (4) Date: Aug. 18, 2011

(87) PCT Pub. No.: WO2010/069900

PCT Pub. Date: Jun. 24, 2010

(65) Prior Publication Data

US 2011/0298878 A1 Dec. 8, 2011

(30) Foreign Application Priority Data

Dec. 17, 2008 (EP) ..... 08171915

(51) Int. Cl.
*B41J 2/01* (2006.01)
*B41M 5/382* (2006.01)
*B41J 3/54* (2006.01)

(52) U.S. Cl.
CPC ..... *B41J 3/54* (2013.01); *B41M 5/38221* (2013.01)
USPC ..... 347/103; 347/56; 347/66; 347/89; 347/101; 347/175; 347/176; 347/186; 347/187; 347/213; 347/215; 347/219; 347/262

(58) Field of Classification Search
CPC ..... B41J 2/01
USPC ..... 347/103, 56, 66, 89, 175, 176, 186, 347/187, 213, 215, 219, 262
See application file for complete search history.

(56) References Cited

U.S. PATENT DOCUMENTS 4,369,451 A * 1/1983 Sekido et al. ..... 347/225
4,712,118 A * 12/1987 Seto et al. ..... 347/248

(Continued)

FOREIGN PATENT DOCUMENTS

EP 0 343 443 11/1989
EP 0 523 647 1/1993

(Continued)

OTHER PUBLICATIONS

U.S. Appl. No. 13/391,779, filed Feb. 22, 2012, Kleine Jaeger, et al.

(Continued)

*Primary Examiner* — Manish S Shah
*Assistant Examiner* — Jeremy Delozier
(74) *Attorney, Agent, or Firm* — Oblon, Spivak, McClelland, Maier & Neustadt, L.L.P.

(57) ABSTRACT

The invention relates to a method for printing a substrate (7) in a printing machine, in which ink is transferred from a flexible carrier (3) to the substrate (7) in accordance with a predefined pattern by energy being introduced into the ink through the flexible carrier (3) by a device for the introduction of energy, some of the ink evaporating in the area of action of the energy and, as a result, a drop of ink (67) being thrown onto the substrate (7) to be printed, this step being repeated at least once, ink being transferred at least partly to the substrate (7) at the same positions in order to intensify the pattern produced. The substrate is transported through the printing machine (1) during the printing and, after the transfer of ink in step (a), the device for the introduction of energy is controlled in such a way that, during the repetition in step (b), the ink is transferred at the same position again as in step (a). The invention further relates to a printing machine for implementing the method.

11 Claims, 2 Drawing Sheets

(56) References Cited

U.S. PATENT DOCUMENTS

| | | | | |
|---|---|---|---|---|
| 4,903,042 | A | 2/1990 | Kaufl et al. | |
| 4,977,417 | A * | 12/1990 | Takanashi et al. | 347/135 |
| 5,021,808 | A | 6/1991 | Kohyama | |
| 5,045,866 | A * | 9/1991 | Chiba et al. | 347/232 |
| 5,183,798 | A | 2/1993 | Sarraf et al. | |
| 5,601,022 | A * | 2/1997 | Dauer et al. | 101/467 |
| 6,222,567 | B1 * | 4/2001 | Schuster et al. | 347/171 |
| 6,231,162 | B1 * | 5/2001 | Nikolaevich et al. | 347/51 |
| 6,241,344 | B1 * | 6/2001 | Machida | 347/66 |
| 6,618,402 | B1 * | 9/2003 | Charbonnier et al. | 372/29.021 |
| 2003/0085986 | A1 | 5/2003 | Sasaki | |
| 2010/0128163 | A1 * | 5/2010 | Nagasaka et al. | 348/348 |

FOREIGN PATENT DOCUMENTS

| | | | |
|---|---|---|---|
| JP | 61-264862 | A | 11/1986 |
| JP | 7 125267 | | 5/1995 |
| JP | 11 48591 | | 2/1999 |
| JP | 2003-011401 | A | 1/2003 |
| JP | 2006 62200 | | 3/2006 |
| WO | 03 074278 | | 9/2003 |

OTHER PUBLICATIONS

U.S. Appl. No. 13/394,011, filed Mar. 2, 2012, Kleine Jaeger, et al.
U.S. Appl. No. 13/394,008, filed Mar. 2, 2012, Kleine Jaeger, et al.

* cited by examiner

PRINTING MACHINE AND METHOD FOR PRINTING A SUBSTRATE

The invention relates to a method for printing a substrate in a printing machine, in which, in a first step, ink is transferred from a flexible carrier to the substrate in accordance with a predefined pattern, by energy being introduced into the ink through the flexible carrier by a device for the introduction of energy, some of the ink evaporating in the area of action of the energy and, as a result, a drop of ink being thrown onto the substrate to be printed, and the step being repeated at least once, ink being transferred at least partly to the substrate at the same positions in order to intensify the pattern produced. Furthermore, the invention relates to a printing machine, comprising a flexible carrier which is coated with an ink to be printed, and a device for the introduction of energy into the ink. The device for the introduction of energy is arranged in such a way that the energy can be introduced in a printing area on the side of the flexible carrier facing away from the ink, so that ink is transferred from the flexible carrier to a substrate to be printed.

A method for printing a substrate in which ink drops are thrown onto a substrate to be printed from a carrier coated with an ink is known, for example from U.S. Pat. No. 6,241,344. In order to transfer the ink, at the position at which the substrate is to be printed, energy is introduced through the carrier into the ink on the carrier. As a result, some of the ink evaporates, so that it is separated from the carrier. As a result of the pressure of the evaporating ink, the drop of ink separated in this way is thrown onto the substrate. By means of directed introduction of the energy, in this way the ink can be transferred to the substrate in accordance with a pattern to be printed. The energy needed to transfer the ink is introduced, for example, by a laser. The carrier to which the ink is applied is, for example, a circulating belt, to which ink is applied with the aid of an application device before the printing area. The laser is located in the interior of the circulating belt, so that the laser acts on the carrier on the side facing away from the ink.

A corresponding printing machine is further known, for example also from U.S. Pat. No. 5,021,808. Here, too, ink from a storage container is applied to a circulating belt by an application device, there being a laser within the circulating belt, by means of which the ink is evaporated at predefined positions and in this way is thrown onto the substrate to be printed. In this case, the belt is fabricated from a material that is transparent to the laser. In order to evaporate the ink in a specific manner, it is possible for the circulating belt to be coated with an absorption layer, in which the laser light is absorbed and converted into heat and thus evaporates the ink at the position at which the laser acts.

The application of the ink to the flexible carrier is in this case generally carried out by roll-based units, a roll dipping into a storage container containing ink, and the ink being transferred to the flexible carrier with the aid of the roll.

During the printing operation, the quantity of the ink layer to be printed can be varied, for example by varying the ink layer thickness on the ink carrier or by varying the laser power. This is disclosed, for example, in WO-A 03/074278.

Alternatively, in order to vary the ink layer thickness, it is possible to print a printed line repeatedly with the same information. In this case, the printed line is built up in a plurality of layers. As a result, the quantity of printing substance to be transferred is virtually unlimited. However, the disadvantage is that in conventional printing machines the substrate to be printed moves continuously onward. As the line print repetition rate increases, the printing precision that can be achieved declines as a result.

It is an object of the present invention to provide a method and a printing machine which make it possible to vary the quantity of the ink layer to be printed by means of multiple printing of a line, improved printing precision being achieved as compared with the methods known from the prior art.

The object is achieved by a method for printing a substrate in a printing machine which comprises the following steps:

(a) transferring ink from a flexible carrier to the substrate in accordance with a predefined pattern by energy being introduced into the ink through the flexible carrier by a device for the introduction of energy, some of the ink evaporating in the area of action of the energy and, as a result, a drop of ink being thrown onto the substrate to be printed, (b) repeating step (a) at least once, ink being transferred at least partly to the substrate at the same positions in order to intensify the pattern produced.

The substrate is transported through the printing machine during the printing and, after the transfer of ink in step (a), the device for the introduction of energy is controlled in such a way that, during the repetition in step (b), the ink is transferred at the same position again as in step (a).

Furthermore, the object is achieved by a printing machine, comprising a flexible carrier which is coated with an ink to be printed, and also a device for the introduction of energy into the ink, the device for the introduction of energy being arranged in such a way that the energy can be introduced in a printing area on the side of the flexible carrier facing away from the ink, so that the ink is transferred from the flexible carrier to a substrate to be printed in an area of action of the energy. The device for the introduction of energy can be controlled in such a way that the area of action of the energy can be moved together with the substrate to be printed or can be moved counter to the transport direction of the substrate, in order to be able to write a line repeatedly, and/or the device for the introduction of energy comprises a plurality of energy generators which are arranged offset from one another in order to compensate for transport of the substrate to be printed, so that a line can be written successively by energy generators following one another.

As a result of the at least one repetition of the transfer of ink to the substrate to be printed at the same position in each case, a multilayer application of ink is achieved. As a result of the multilayer application of ink, a more intensive image is produced on the substrate. As a result of moving the area of action of the energy on the flexible carrier together with the substrate to be coated, it is ensured that the repeated application of ink is carried out at exactly the same position as the preceding application of ink. In this way, as compared with the methods known from the prior art, the printing precision can be improved.

In order to be able to transfer the ink in a plurality of layers in each case at the same position to the substrate to be printed, in one embodiment of the invention the substrate is transported line by line in each case following the printing of a line. In this case, the line is printed first; if multiple application of ink is desired in the line, the multiple application of the line is carried out and only after the line has been written completely is the substrate to be printed moved onward in order to print the next line. However, line by line transport is also possible in that a line is printed first; following the printing of the line the substrate is moved onward and the device for the introduction of energy is controlled in such a way that this likewise moves onward by a line, so that the next line is printed on the substrate at the same position as the preceding one and thus a multiple application is possible.

However, it is preferred if the substrate is transported continuously through the printing machine. Continuous transport is preferred in particular when large and heavy substrates are to be printed. In this case, together with the substrate to be printed, a continuous movement of the area of introduction of the energy is carried out in order to print the substrate. Only after the printing of a line has been completed, for example multiple printing or single printing, is the device moved relative to the substrate to be printed in such a way that the next line can be printed. In addition to single-line printing, it is of course alternatively also possible to print a plurality of lines first, then to move the area of action of the energy relative to the substrate such that renewed printing is carried out at the same positions, and thus multiple printing with a multilayer application of ink is possible.

In the case of multiple printing, it is advantageous to move the substrate at a lower speed than in the case of single printing, in order to provide sufficient time to implement a multiple application of ink.

If the device for the introduction of energy comprises a plurality of energy generators, the multiple printing is implemented by the line being written once by one energy generator in each case, a first energy generator writing the line a first time and a line being overwritten by further energy generators that are present until the desired number of superimposed line prints has been reached. The maximum number of superimposed line prints in this embodiment corresponds to the number of energy generators. In order to be able to print at the same position on the substrate in each case, the energy generators are arranged offset. In this way, it is possible to compensate for the transport of the substrate.

Furthermore, in one embodiment, it is also possible for a plurality of energy generators to be provided and, in addition, for one of the energy generators to be controllable in such a way that the area of action of the energy generator can be moved together with the substrate. In this way, it is possible to print a line successively with different energy generators and, at the same time, also to print a line repeatedly with one energy generator. In this way, the number of superimposed line prints can be greater than the number of energy generators.

In order to achieve a clean printed image, the area of action of the energy on the ink is preferably point-like. This is achieved in particular by the energy being introduced into the ink through the flexible carrier in a focused manner. The size of the point onto which the energy to be introduced is focused in this case corresponds to the size of the dot to be transferred. The dots to be transferred preferably have a diameter in the range from 10 to 200 μm, in particular in the range from 40 to 100 μm. However, the size of the dot to be transferred can differ, depending on the substrate to be printed and the printed result produced therewith. For instance, it is possible to choose a larger focus, in particular during the production of printed circuit boards. On the other hand, in the case of printed products in which a text is represented, small printing dots are generally preferred in order to produce a clear text image. In addition, when printing images and graphics, it is advantageous to print the smallest possible dots in order to produce a clear image.

In order to obtain a multilayer application of ink, it is possible, with the method according to the invention, to print a line or a number of lines singly first and then to overprint the lines again, to provide parts of a line with a multilayer application of ink or to print only individual dots repeatedly one after another and, in this way, already to produce the individual dot in a multilayer application of ink. The multiple printing of individual dots has the advantage that, both in the case of multiple printing of a line and in the case of single printing, in each case only one line movement of the device for the introduction of energy is needed per line, and no multiple line movement.

The flexible carrier used in the printing machine, which is coated with the ink to be printed, is preferably configured in the form of a belt. The flexible carrier is particularly preferably a thin sheet. In this case, the thickness of the flexible carrier preferably lies in the range from 1 to 1000 μm, in particular in the range from 10 to 300 μm. It is advantageous to implement the carrier with a low thickness if possible, in order that the energy introduced through the carrier is not scattered in the carrier, and thus a clean printed image is produced. For example, polymer films that are transparent to the energy used are suitable as a material. Suitable polymers are, for example, polyimides.

In one embodiment of the printing machine, the flexible carrier is stored in a suitable device. To this end, it is possible, for example, for the carrier which is coated with ink to be wound up into a roll. For the purpose of printing, the carrier coated with ink is then unwound and guided over the printing area, in which, with the aid of a laser, ink is transferred from the carrier to the substrate to be printed. The carrier is then wound up onto a roll again, for example, which can then be sent to disposal. However, it is preferred for the flexible carrier to be formed as a circulating belt. In this case, ink is applied to the flexible carrier by a suitable application device before said carrier reaches the printing position, which means the point at which the ink is transferred from the carrier to the substrate to be printed with the aid of the input of energy. After the printing operation, some of the ink has been transferred from the carrier to the substrate. As a result, there is no longer any homogeneous film of ink on the carrier. For a subsequent printing operation, it is therefore necessary to coat the carrier with ink again. This is carried out during the next passage past the appropriate position on the ink application device. In order to avoid ink drying on the flexible carrier and in order in each case to produce a uniform layer of ink on the carrier, it is advantageous to remove the ink on the carrier first before a subsequent application of ink to the carrier. The removal of the ink can be carried out, for example, with the aid of a roller or a doctor. If a roller is used for the removal of the ink, then it is possible to use the same roller with which the ink is also applied to the carrier. To this end, it is advantageous if the rotational movement of the roller is opposed to the movement of the flexible carrier. The ink removed from the flexible carrier can then be fed to the ink supply again. If a roller is provided to remove the ink, it is of course also alternatively possible for one roller to be provided for the removal of the ink and one roller for the application of ink.

If the ink is to be removed from the flexible carrier by a doctor, then any desired doctor known to those skilled in the art can be used.

In order to avoid the flexible carrier being damaged during the application of the ink or during the removal of the ink, it is preferable for the flexible carrier to be pressed with the aid of a backing roll against the applicator roll with which the ink is applied to the carrier or the roller with which the ink is removed from the carrier or the doctor with which the ink is removed from the carrier. In this case, the back pressure is adjusted in such a way that the ink is removed substantially completely but no damage to the flexible carrier occurs.

The device for the introduction of energy preferably comprises at least one laser. The advantage of a laser is that the laser beam used can be focused onto a very small cross section. A targeted input of energy is thus possible. In order to evaporate the ink from the flexible carrier at least partly and to transfer it to the substrate, it is necessary to convert the light from the laser into heat. To this end, it is firstly possible for a suitable absorber to be contained in the ink, which absorbs the laser light and converts it into heat. Alternatively, it is also possible for the flexible carrier to be coated with an appropriate absorber or to be made from such an absorber or to contain such an absorber, which absorbs the laser light and converts it into heat. However, it is preferred for the flexible carrier to be made from a material that is transparent to the laser radiation and for the absorber which converts the laser light into heat to be contained in the ink. Suitable absorbers are, for example, carbon blacks, metal nitrites or metal oxides.

Suitable lasers which are used to transfer the ink from the flexible carrier to the substrate are, for example, fiber lasers, which are operated in the basic mode. In order to be able to print a line repeatedly, it is preferred for the printing machine to comprise a control unit, with which the device for the introduction of energy can be controlled. In this case, the control unit is in particular configured such that exact multiple printing is possible without any slight line offset arising, so that no ink applied in a following layer is printed beside the previous layer.

When a laser is used as a device for the introduction of energy, the control unit in a first embodiment comprises a controllable mirror device. Using the controllable mirror device, the laser beam can be deflected onto the pattern to be printed in accordance with the requirements. Using a suitable actuation system and suitable drives for the mirrors, very precise control of the laser is possible in this way. The drives used for the mirrors are, for example, actuating motors, as are known to those skilled in the art.

As an alternative to a controllable mirror device, it is also possible to control the laser, for example, by using at least one acousto-optical or electro-optical modulator. The use of a plurality of acousto-optical or electro-optical modulators or the use of acousto-optical and electro-optical modulators is also possible. In addition, a controllable mirror device can also be provided in addition to the modulators.

In a third embodiment, the control unit comprises controllable lens systems, with which the laser can be controlled in such a way that multiple printing of a line on the substrate is possible. By means of the controllable lens systems, firstly the laser is focused, so that it can be focused more precisely; secondly accurate selection of a point on the flexible carrier is therefore possible, in order to be able to transfer a dot of ink in a specific manner to the substrate to be printed. The control of the lenses is carried out, for example, by tilting individual lenses or by displacing the lenses. To this end, just as in the case of the controllable mirror device, actuating motors known to those skilled in the art are preferably used. In addition, the controllable lens system can be used together with a controllable mirror device and/or acousto-optical or electro-optical modulators.

In addition to the use of a control unit, by means of which for example the laser used is controlled in a specific manner in order to implement multiple printing, it is alternatively also possible that the area of action of the energy can be moved together with the substrate or moved counter to the transport direction of the substrate by the device for the introduction of energy being accommodated such that it can move. In this case, the entire device for the introduction of energy is moved concomitantly. This is necessary, for example, if energy other than a laser is used. In particular when a laser is used, however, it is preferred to use a control device with which the laser beam can be deflected in a specific manner in order to permit multiple printing.

In addition to the use of only one laser, it is moreover also possible for the device for the introduction of energy to comprise at least two lasers as energy generators, which are arranged offset from one another, in order to be able to compensate for the line offset produced by the advance of the substrate. In this case, a line is printed first with the aid of the first laser and then a second print is then made at the same printing position as the first line by using the second laser, so that a line is printed repeatedly by using a plurality of lasers. Displacement of the laser in the transport direction of the substrate for multiple overprinting of the same line is then not necessary. The deflection of the laser in the transport direction of the substrate can thus be reduced. However, if the intention is also to implement multiple prints in which the number of superimposed prints of a line is greater than the number of lasers present, it is additionally possible to control at least one laser such that the latter can write a line repeatedly.

To improve the printed image, it is moreover possible to provide a tensioning device, with which the flexible carrier is tensioned, in order for example to smooth out waves in the flexible carrier. In addition, by using a tensioning device, for example the distance between the flexible carrier and the substrate to be printed can also be adjusted. This makes it possible to set a constant distance between flexible carrier and substrate to be printed even in the case of multiple printing, and thus to ensure uniform printing quality. A tensioning device with which the printing gap can be adjusted and the flexible carrier can be smoothed comprises, for example, at least two guide elements, which are arranged on the two sides of the device for the introduction of energy. In this case, in the transport direction of the flexible carrier, in general at least one guide device is arranged before the device for the introduction of energy and at least one guide device is arranged after the device for the introduction of energy. By means of the guide elements, the flexible carrier is tensioned precisely in the region in which the energy is introduced and the ink is transferred to the substrate to be printed. Alternatively, it is also possible to use only one guide element. In this case, the guide element is located precisely in the path of the energy to be introduced, so that the guide element must be transparent to the energy to be introduced. Suitable as a guide element in this case is, for example, a transparent rod or preferably a guide element which is formed as a rod lens. The advantage of the use of a rod lens is that the laser is focused in the latter and thus the printing quality can be improved further. In order to be able to implement multiple printing in which the area of action of the energy is moved with the substrate to be printed, it is necessary for the tensioning device to move together with the area of action of the energy. Alternatively, when at least two guide elements are used, these can also be positioned so far from each other that the distance between the guide elements is sufficient to implement multiple printing. Suitable guide elements are, for example, tensioning rollers or rigid guide elements but, in the region in which the flexible carrier is guided over the rods, they must not be sharp-edged, in order to avoid damage to the flexible carrier.

Any desired printing ink known to those skilled in the art is suitable as the ink which can be transferred to the substrate to be printed by the printing machine according to the invention. The ink can be both liquid and solid. However, the use of liquid inks is preferred. These preferably have a viscosity of less than 10,000 mPas and particularly preferably a viscosity of less than 1000 mPas. Liquid inks that are used normally contain at least one solvent and color-forming solids, for example pigments. Alternatively, however, it is also possible for the ink to contain a solvent and electrically conductive particles dispersed in the solvent, for example. In this case, for example, a circuit board can be printed with the ink used. In addition, in particular when a laser is used for the input of energy, it is preferable if the ink also contains an additive which absorbs the laser radiation and converts it into heat. Suitable additives are, for example, carbon black pigments or metal oxide pigments.

If conventional printing inks are used, then the substrate to be printed is preferably paper. However, any other desired substrate can also be printed with the device according to the invention. By using the printing machine according to the invention, for example paperboard or other paper products, plastics, for example plastic films such as are used for packaging, metal foils or composite films can also be printed. The printing machine and the method are also suitable for printing circuit boards. In this case, the substrate to be printed is usually any desired circuit board substrate known to those skilled in the art. The circuit board substrate can be both solid and flexible.

Embodiments of the invention are illustrated in the drawings and will be explained in more detail in the following description.

Figure 1:
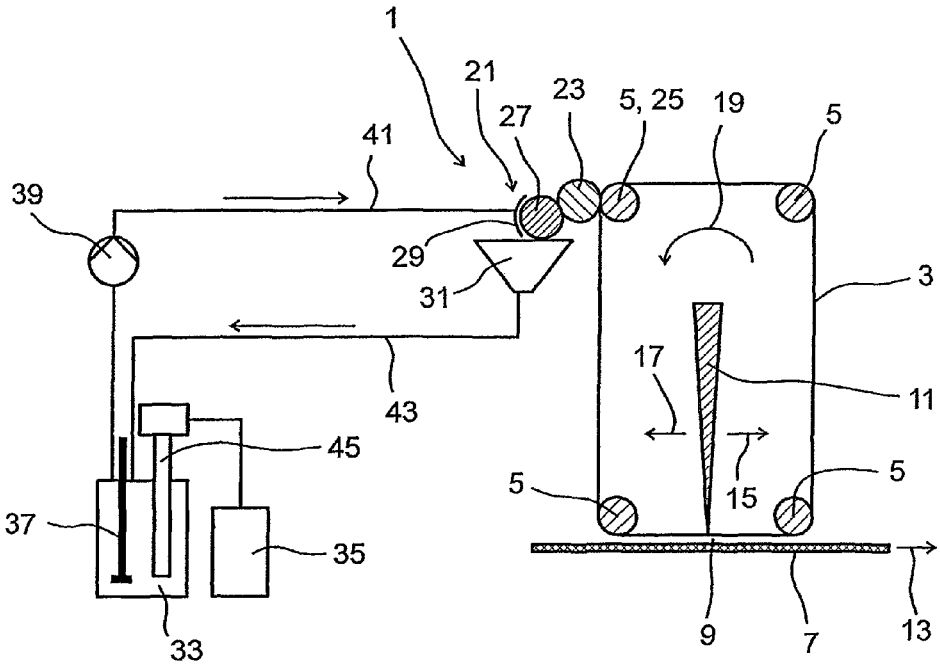
FIG. 1 shows a schematic illustration of a printing machine constructed in accordance with the invention.

A printing machine 1 comprises a flexible carrier 3 which, in the embodiment illustrated here, is designed as an endless belt and is led around a plurality of deflection rollers 5. An ink for printing a substrate 7 is applied to the flexible carrier 3.

To print the substrate 3, energy is introduced into the ink through the flexible carrier 3 in a printing area 9. As a result of the introduction of the energy into the ink, some of the ink evaporates, by which means a drop of ink is thrown onto the substrate 7. Suitable as the energy which is introduced into the ink is, for example, a laser 11. Suitable lasers 11 which can be used in order to introduce energy into the ink are, for example, fiber lasers. The advantage of the use of a laser 11 is that the latter can be focused onto a very small point with a cross section in the range from 10 to 100 μm and in this way a very accurate printed image can be produced.

In order to permit multiple printing of individual lines during the transport of the substrate 7 in the transport direction 13, according to the invention the laser 11 can be moved together with the substrate 7 in the transport direction 13 of the latter or moved counter to the transport direction 13 of the substrate 7. The movement of the laser 11 in the transport direction 13 of the substrate 7 is illustrated by a first arrow 15, and the movement of the laser 11 counter to the transport direction 13 of the substrate 7 is illustrated by a second arrow 17. As a result of the movement of the laser 11, it is thus possible to write a line exactly repeatedly without the edges of the pattern to be printed becoming unclear. The respective next ink layer can in this way be applied at exactly the same position as that applied previously. Once a line has been printed repeatedly, following the printing of the line the laser 11 is moved into the next line in order then to print the latter. If multiple printing is envisaged, it is advantageous that the substrate 7 is moved more slowly than in the case of single printing, in order to be able to print the substrate 7 within the movement window of the laser 11.

In order in each case to be able to transfer fresh ink to the substrate 7, it is necessary to guide the laser in each case over areas of the flexible carrier from which no ink has yet been removed. To this end, the flexible carrier 3 is moved around the deflection rollers 5 at constant speed. The transport direction of the flexible carrier 3 is illustrated by an arrow 19.

The ink which is printed on the substrate 7 in the printing area 9 is applied to the flexible carrier 3 by an application device 21. In order to ensure a uniform application of ink, the application device 21 in the embodiment illustrated here comprises an applicator roll 23, with which the ink is applied to the flexible carrier 3. The contact pressure required to apply the ink is implemented by means of a backing roll 25, which serves at the same time as a deflection roller for the flexible carrier 3. The ink is applied to the applicator roll 23 with the aid of an inking roll 27. In the embodiment illustrated here, the inking roll 27 is inked via an inking plate 29. As an alternative to the inking plate 29, however, the inking roll 27 can also be coated with ink by any other desired device known to those skilled in the art. For instance, it is possible for the inking roll 27 to dip into a storage container and thus be coated with ink. It is also possible to dispense with the inking roll 27 and for only one applicator roll 23 to be provided. It is also possible for more than two rolls to be provided in order to apply the ink to the flexible carrier 3.

In order to collect ink dripping off the inking roll 27, a drip catcher 31 is provided in the embodiment illustrated here. Ink collected by the drip catcher 31 is led back into a storage container 33, which contains the ink. The ink contained in the storage container 33 can have solvent added to it from a solvent container 35 as needed. This is necessary, for example, in order to replace solvent that has evaporated from the storage container 33. It is also possible to use the solvent container 35 to supplement solvent, which is evaporated from the ink which has been applied to the flexible carrier 3 and has been removed from the latter again with the aid of the applicator roll 23 after the printing and led back into the storage container 33. In order to keep the ink in the storage container 33 homogeneous, a stirrer mechanism 37 is also preferably provided. Any desired stirrer mechanism known to those skilled in the art is suitable as the stirrer mechanism 37. For instance, any desired stirrer can be provided. Suitable stirrers are, for example, propeller stirrers, disk stirrers, lattice stirrers, plate stirrers, anchor-shaped stirrers or radial stirrers.

The amount of solvent which has to be metered into the storage container 33 from the solvent container 35 can be determined, for example, by means of viscosity measurement of the ink in the storage container 33. To this end, it is possible, for example, to equip the storage container 33 with a viscometer 45. Via the viscometer 45, the amount of solvent to be metered in is then determined. The viscometer 45 is preferably equipped with an automatic metering system for the solvent.

From the storage container 33, the ink is transported by a circulating pump 39 through a feed line 41 to the inking plate 29. The ink is then applied to the inking roll 27 by the inking plate 29. Excess ink drips back into the drip catcher 31 and from there runs back into the storage container 33 via a return line 43.

In order to avoid ink drying on the flexible carrier 3 and thus leading to irregularities and therefore to an impairment of the printed image, ink not transferred to the substrate 7 is removed from the flexible carrier 3 again with the aid of the applicator roll 23 after printing. To this end, it is advantageous if the direction of rotation of the applicator roll 23 is opposed to the transport direction 17 of the flexible carrier 3. The ink removed from the flexible carrier 3 with the aid of the applicator roll 23 is wiped off the applicator roll 23 with the aid of the inking roll 27 and drips into the drip catcher 31, from which it is conveyed back into the storage container 33 via the return line 43.

As an alternative to the applicator roll 23 with which the ink is removed from the flexible carrier 3, it is also possible to remove the ink from the flexible carrier 3, for example with the aid of a doctor or any other desired device, before new ink is applied. In addition, it is for example possible to provide a second roll, with which the ink is removed from the flexible carrier 3.

In order to improve the printed image, it is possible, in one embodiment, to provide a tensioning device in the printing area 9, with which the flexible carrier 3 can be tensioned, in order in this way to avoid irregularities and waves in the flexible carrier. In addition, by using such a tensioning device, for example it is also possible for a constant distance to be set between the flexible carrier and the substrate 7 to be printed. Such a tensioning device comprises, for example, a guide element over which the flexible carrier 3 is guided. If only one guide element is provided, this is then preferably transparent to the energy to be introduced, that is to say to the laser 11 in the embodiment illustrated here. The laser 11 is then led to the flexible carrier 3 through the guide element.

Alternatively, it is also possible, for example, to provide two guide elements, of which one guide element is located before and one guide element is located after the laser 11. If there is a short distance between the guide elements, these move together with the laser. Alternatively, it is also possible to keep the distance between the guide elements so large that the laser can be moved between these together with the substrate or can be moved counter to the transport direction 13 of the substrate 7.

By means of such a tensioning device, the printing area 9 can be implemented with constant dimensions. This makes it possible to keep the printing gap between the flexible carrier 3 and the substrate 7 to be printed homogenous and, as a result, to implement constant printing conditions and thus to improve the printed image.

Figure 2:
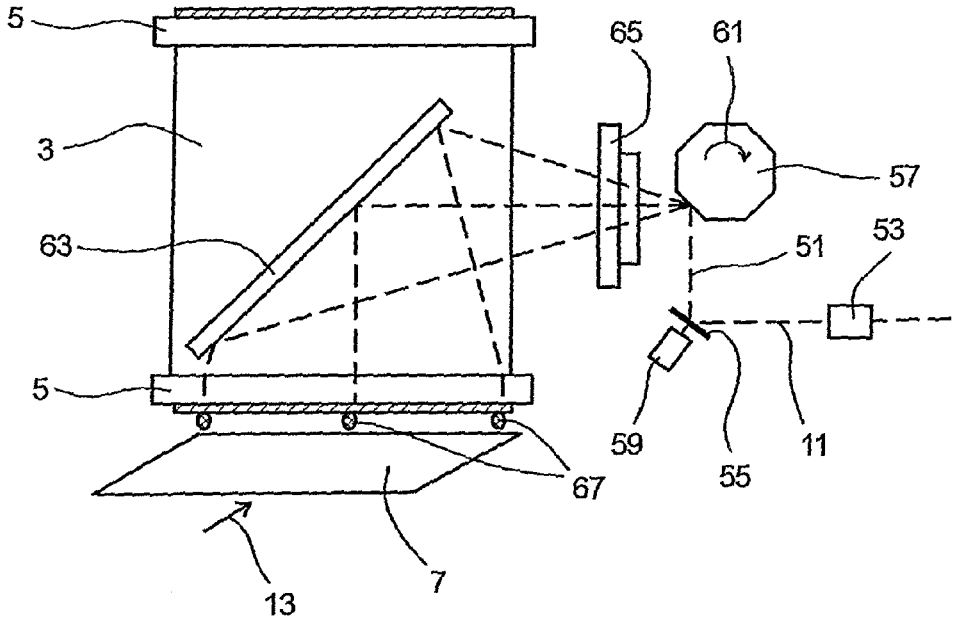
FIG. 2 shows a schematic illustration of a device according to the invention for the introduction of energy.

FIG. 2 shows in detail a device for the introduction of energy, with which multiple printing during transport of the substrate to be printed is possible.

In the embodiment illustrated here, the energy is introduced into the flexible carrier 3 with the aid of a laser 11 in order to transfer ink to the substrate to be printed. In order to achieve multiple printing, that is to say multiple printing of a line in order to increase the layer thickness of the ink on the substrate 7 to be printed, the laser beam 51 is first led via a laser modulator 53. In the laser modulator 53, for example an AOM or EOM, the intensity of the laser 11 can be varied. In this way, for example, the laser can be switched on and off in order to print only specific areas in a line. Alternatively, however, it is also possible for example to use an acousto-optical or an electro-optical modulator with which the laser beam can be deflected, in order to permit multiple printing with a moving substrate 7.

After leaving the laser modulator 53, the laser beam 51 is led via a deflection mirror 55 to a polygonal mirror 57. The deflection mirror 55 comprises, for example, an actuating motor 59 with which the direction of the deflection mirror 55 can be varied. By this means, the laser beam 51 can be moved with the substrate 7 in the transport direction 13 or counter to the transport direction. At the polygonal mirror 57, the laser beam 51 is deflected in accordance with the desired line position. To this end, the polygonal mirror 57 is rotatable, as illustrated here by an arrow 61.

In order to keep the laser focus in one plane following reflection at a 45° mirror 63, an f-theta objective 65 is positioned between the polygonal mirror 57 and the 45° mirror 63. Depending on the position of the dot to be printed, the laser is deflected at the polygonal mirror 57, led through the f-theta objective 65, reflected at the 45° mirror and thus its focal point meets the flexible carrier 3, which is coated with an ink layer. The energy of the laser 11 is converted into heat in an adsorption layer on the flexible carrier 3 or by a suitable adsorbent in the ink. In this way, some of the solvent in the ink evaporates and a drop of ink 67 is formed. The drop of ink separates from the flexible carrier 3 and is thrown onto the substrate 7 to be printed, where it subsequently dries and thus supplies a printed ink dot. In this way, any desired pattern can be represented. In order to intensify the pattern, according to the invention deflection with the aid of the deflection mirror 55 makes multiple printing possible, in which ink is applied in a plurality of layers to the substrate 7 to be printed.

In addition to the embodiment illustrated here with laser modulator 53 and deflection mirror 55, it is alternatively also possible to use only one laser modulator or a plurality of laser modulators or alternatively only deflection mirrors to deflect the laser beam 51. Furthermore, the deflection of the laser beam can also be implemented by means of suitable controllable lenses. In addition, any desired combination of controllable lenses, deflection mirrors and laser modulators is conceivable.

Furthermore, it is also still possible, instead of the controlled laser or as an alternative thereto, to use a plurality of lasers which are arranged offset from one another in order to compensate for the transport of the substrate 7 and with which a line can be written successively repeatedly, each laser printing the line once.

LIST OF DESIGNATIONS

1 Printing machine
3 Flexible carrier
5 Deflection roller
7 Substrate
9 Printing area
11 Laser
13 Transport direction of the substrate 7
15 Movement in transport direction 13
17 Movement counter to the transport direction 13
19 Transport direction of the flexible carrier 3
21 Application device
23 Applicator roll
25 Backing roll
27 Inking roll
29 Inking plate
31 Drip catcher
33 Storage container
35 Solvent container
37 Stirrer mechanism
39 Circulating pump
41 Feed line
43 Return line
45 Viscometer
51 Laser beam
53 Laser modulator
55 Deflection mirror
57 Polygonal mirror
59 Actuating motor
61 Rotation of the polygonal mirror 57
63 45° mirror
65 f-theta objective
67 Drop of ink

The invention claimed is:

1. A method for printing a substrate in a printing machine, comprising:

(a) transferring ink from a flexible carrier to the substrate in accordance with a predefined pattern by introducing energy into the ink through the flexible carrier by a device suitable for introducing the energy, wherein some of the ink evaporates in an area of action of the energy and, as a result, a drop of ink is thrown onto the substrate to be printed, (b) repeating the transferring (a) at least once, wherein ink is transferred at least partly to the substrate at the same position in order to intensify a pattern produced, wherein the substrate is transported through the printing machine during the printing and, after the transferring (a), the device for introducing the energy is controlled in such a way that, during the repeating (b), the ink is transferred at the same position again as in (a), wherein the substrate is transported continuously through the printing machine and, in order to repeat the transferring (a), the device for introducing the energy is moved together with the substrate in order to apply ink to the substrate at the same position.

2. The method of claim 1, wherein the device for introducing the energy comprises at least one laser.

3. The method of claim 2, wherein the laser is controlled by at least one selected from the group consisting of a controllable lens system, a controllable mirror, and a laser modulator for the multiple writing of a line.

4. The method of claim 2, wherein the device for introducing the energy comprises a plurality of lasers which are arranged offset from one another, in order to compensate for transport of the substrate, so that the repeating (b) is in each case carried out by a different laser.

5. The method of claim 3, wherein the device for introducing the energy comprises a plurality of lasers which are arranged offset from one another, in order to compensate for transport of the substrate, so that the repeating (b) is in each case carried out by a different laser.

6. A printing machine, comprising:

a flexible carrier, which is coated with an ink to be printed; and an energy device suitable for introducing energy into the ink, wherein the energy device is arranged in such a way that the energy can be introduced in a printing area on a side of the flexible carrier that faces away from the ink, so that ink is transferred from the flexible carrier to a substrate to be printed in an area of action of the energy, wherein the energy device can be controlled in such a way that the area of action of the energy can be moved together with the substrate to be printed or can be moved counter to a transport direction of the substrate, in order to be able to write a line repeatedly, and/or wherein the energy device comprises a plurality of energy generators which are arranged offset from one another in order to compensate for transport of the substrate to be printed, so that a line can be written successively by energy generators following one another, wherein a control unit is comprised, with which the energy device can be controlled such that a line can be printed repeatedly by transporting the substrate continuously through the printing machine and, in order to repeat (a) transferring ink from a flexible carrier to the substrate in accordance with a predefined pattern by introducing energy into the ink through the flexible carrier by a device, wherein some of the ink evaporates in an area of action of the energy and, as a result, a drop of ink is thrown onto the substrate to be printed, the energy device is moved together with the substrate in order to apply ink to the substrate at the same position.

7. The machine of claim 6, wherein the energy device comprises at least one laser suitable as an energy generator.

8. The machine of claim 6, wherein the control unit comprises a controllable mirror device.

9. The machine of claim 6, wherein the control unit comprises an acousto-optical or electro-optical modulator.

10. The machine of claim 6, wherein the control unit comprises at least one controllable lens system.

11. The machine of claim 6, wherein an area of action of the energy can be moved together with the substrate or can be moved counter to transport direction of the substrate, by the energy device being configured such that it can move.

* * * * *

UNITED STATES PATENT AND TRADEMARK OFFICE

CERTIFICATE OF CORRECTION

PATENT NO. : 8,840,237 B2
APPLICATION NO. : 13/140480
DATED : September 23, 2014
INVENTOR(S) : Frank Kleine Jaeger et al.

It is certified that error appears in the above-identified patent and that said Letters Patent is hereby corrected as shown below:

On the title page, Item (12), the Letters Patent Heading, and Item (75), the 1st Inventor's Last Name are incorrect. Item (12) and (75) should read:

--(12) United States Patent
Kleine Jaeger et al.

(75) Inventors: Frank Kleine Jaeger, Bad Duerkheim (DE);
Juergen Kaczun, Wachenheim (DE);
Udo Lehmann, Waldalgesheim (DE)--

Signed and Sealed this
Sixth Day of January, 2015

Michelle K. Lee

Michelle K. Lee
*Deputy Director of the United States Patent and Trademark Office*